US008678872B1

(12) United States Patent
Valencia

(10) Patent No.: US 8,678,872 B1
(45) Date of Patent: Mar. 25, 2014

(54) TALKING PINATA

(76) Inventor: Octavio Valencia, Ripon, CA (US)

( * ) Notice: Subject to any disclaimer, the term of this patent is extended or adjusted under 35 U.S.C. 154(b) by 206 days.

(21) Appl. No.: 13/425,219

(22) Filed: Mar. 20, 2012

(51) Int. Cl.
*A63H 33/00* (2006.01)

(52) U.S. Cl.
USPC ..... 446/5

(58) Field of Classification Search
USPC ..... 446/5, 308–312, 475, 486; 229/116.1; 273/108, 317
See application file for complete search history.

(56) References Cited

U.S. PATENT DOCUMENTS

| | | | | |
|---|---|---|---|---|
| 4,787,872 | A | 11/1988 | Bajo | |
| 4,832,337 | A | 5/1989 | Estrada | |
| 5,263,889 | A * | 11/1993 | Ledonne | 446/5 |
| 5,375,839 | A * | 12/1994 | Pagani | 473/570 |
| 6,354,904 | B1 * | 3/2002 | Grey et al. | 446/5 |
| 6,716,031 | B2 * | 4/2004 | Wood et al. | 434/159 |
| 7,006,001 | B2 | 2/2006 | Estrada et al. | |
| 7,086,545 | B2 | 8/2006 | Mannion et al. | |
| 7,377,567 | B2 * | 5/2008 | Walsh | 294/82.28 |
| 2003/0190858 | A1 | 10/2003 | Thomas | |
| 2007/0298647 | A1 | 12/2007 | Lee et al. | |
| 2009/0242455 | A1 | 10/2009 | Adams et al. | |
| 2012/0197428 | A1 * | 8/2012 | Weaver | 700/117 |

* cited by examiner

*Primary Examiner* — Kurt Fernstrom
(74) *Attorney, Agent, or Firm* — Richard L. Miller

(57) ABSTRACT

A reusable, programmable, interactive, and talking pinata for being hit by a stick by a size-insensitive user to dispense bounty and for depicting interchangeable and disposable characters. The pinata includes a character, a first compartment, operating electronics, and a second compartment. The character has a body and depicts the interchangeable and disposable characters, and as such, is interchangeable and disposable. The body has a top part and a bottom part. The bottom part is pivotally attached to the top part so as to pivot relative thereto. The operating electronics has preselected criteria. The second compartment has a bottom lid, and holds the bounty. The bottom lid is affixed to the bottom part so as to pivot therewith. When the pinata is activated by being hit by the stick, the bottom part pivots away from the top part, and in doing so, opens the second compartment and dispenses the bounty.

33 Claims, 7 Drawing Sheets

TALKING PINATA

1. BACKGROUND OF THE INVENTION

A. Field of the Invention

The embodiments of the present invention relate to a pinata, and more particularly, the embodiments of the present invention relate to a reusable, programmable, interactive, and talking pinata for being hit by a stick by a size-insensitive user to dispense bounty and for depicting interchangeable and disposable characters.

B. Description of the Prior Art

A pinata is a man-made object made in various shapes and styles, which is normally filled with candy. It is generally used at children's birthday parties as a fun game or party activity that results in the children "winning" the candy that is inside it by breaking open the pinata with a stick.

The pinata is tied to a middle part of a horizontally oriented rope. The children take turns hitting it with the stick with the intent of breaking it—sometimes while blindfolded.

An adult generally keeps moving the pinata by pulling on one end of the rope so as to make it hard for the children to actually hit the pinata. When they finally break it, all the candy falls down and the children then reach for it, grabbing for themselves as much as they can.

Numerous innovations for pinatas and the like have been provided in the prior art, which will be described below in chronological order to show advancement in the art, and which are incorporated herein by reference thereto. Even though these innovations may be suitable for the specific individual purposes to which they address, however, they differ from the present invention in that they do not teach a reusable, programmable, interactive, and talking pinata for being hit by a stick by a size-insensitive user to dispense bounty and for depicting interchangeable and disposable characters.

(1) U.S. Pat. No. 4,787,872 to Bajo.

U.S. Pat. No. 4,787,872 issued to Bajo on Nov. 29, 1988 in U.S. class 446 and subclass 5 teaches a reusable pinata having a body with a frangible bottom closure surface that is replaceable, and a top closure surface that is outlined to define punch-out or cut-out areas for permitting access to the interior of the pinata body when desired. The pinata may have a hood overlying the top closure surface and the body. The hood is preferably bell-shaped and formed from at least one expansible paper unit.

(2) U.S. Pat. No. 4,832,337 to Estrada.

U.S. Pat. No. 4,832,337 issued to Estrada on May 23, 1989 in U.S. class 273 and subclass 440 teaches a reusable pinata for dispensing tokens or object that have a predetermined configuration to fit cavities in boards. The objects are dispensed when strings are pulled that open the closure members that are pivotally mounted to the bottom of a hollow container. The container is suspended from a stand assembly that includes a base, an upwardly extending pole member, and an arm member that is substantially perpendicular to the pole member. A timer is mounted to the pole member.

(3) United States Patent Application Publication Number 2003/0190858 to Thomas.

United States Patent Application Publication Number 2003/0190858 published to Thomas on Oct. 9, 2003 in U.S. class 446 and subclass 484 teaches an interactive pinata equipped with an electronic recording/playback system. The recording system can either play previously recorded messages, or in an alternative embodiment, the system can record and play back original messages from a person, such as the owner. In either embodiment, the pinata can respond to being struck—or missed—by playing a message. The pinata may be embodied with cartoon or celebrity voices being prerecorded. Finally, the recording system could be operated via a type of remote control, ranging from simple pushbuttons to a karaoke-like arrangement.

(4) U.S. Pat. No. 7,006,001 to Estrada et al.

U.S. Pat. No. 7,006,001 issued to Estrada et al. on Feb. 28, 2006 in U.S. class 340 and subclass 692 teaches a speech or phrase emitting celebration device, in the nature of a pinata, includes a longitudinal axial channel within which is placed a complementally sized integrated circuit ("IC") including a library of pre-programmed voice chips having phrases selected by random. The circuit is responsive to impacts or shocks upon a fanciful housing of the device sufficient to actuate a shock sensor switch thereof. A speaker, in electrical communication with the circuit board of the integrated circuit is in mechanical communication with a speaker at an end of the channel so that the emitted phrase may be heard by those in the vicinity of the device. A hollow cylindrical sensor may be disposed within the interior channel to provide appropriate input to the shock sensor switch or a more sensitive discrete element sensor may be used.

(5) U.S. Pat. No. 7,086,545 to Mannion et al.

U.S. Pat. No. 7,086,545 issued to Mannion et al. on Aug. 8, 2006 in U.S. class 211 and subclass 181.1 teaches a support for a predetermined container, which has a rim, e.g., at its top opening. The support includes a lid or a supporting ring, constructed to interfit, e.g., with the rim of the container. There is a suspender formed with the lid or supporting ring and deflectable from an as-formed position to an upstanding position in which it is capable of carrying weight of the container. In most cases, suspenders extend inwardly of a rim of the lid or the supporting ring. Free-ended flexible finger suspenders of synthetic resin formed integrally with the lid or the supporting ring as a molded unit. The lids or rings are associated with closure surfaces, such as closure portions molded with the lid or the ring, closure inserts, or closure films or foils on the container itself. The suspenders are useful to the consumer in enabling improved carrying of the merchandise with other items or in intertwined fusion with the like items and to the storekeeper in suspending merchandise. Combinations of the lids or supporting rings with containers containing prepackaged food, tennis balls, and other contents are displayed by storekeepers from hooks and racks; in many cases hanging at a substantial tilt angle for better visibility and utilization of stocking space.

(6) United States Patent Application Publication Number 2007/0298647 to Lee et al.

United States Patent Application Publication Number 2007/0298647 published to Lee et al. on Dec. 27, 2007 in U.S. class 439 and subclass 354 teaches a reusable pinata including a non-frangible housing having a treat discharge port formed therein and a target mounted thereon. A mechanism mounted within the housing discharges treats through the treat discharge port when the target is engaged by a thrown object.

(7) United States Patent Application Publication Number 2009/0242455 to Adams et al.

United States Patent Application Publication Number 2009/0242455 published to Adams et al. on Oct. 1, 2009 in U.S. class 206 and subclass 575 teaches a punch-through gift container for use in party and game play environments providing in one embodiment an enclosed container including a rigid backwall, rigid sidewalls, and an internally positioned matrix of interlocking rigid partitions creating within the container a plurality of compartments. The front wall of the container includes a thin fungible wrapper affixed to the front of the container, with a plurality of aiming targets adorned on the exterior of the wrapper to indicate the center of each compartment contained therein. Gifts placed within the compartments of the container are retrieved from the chosen compartment by punching or otherwise breaking the wrapper through the aiming target corresponding to the chosen compartment.

It is apparent that numerous innovations for pinatas and the like have been provided in the prior art that are adapted to be used. Furthermore, even though these innovations may be suitable for the specific individual purposes to which they address, however, they would not be suitable for the purposes of the embodiments of the present invention as heretofore described, namely, a reusable, programmable, interactive, and talking pinata for being hit by a stick by a size-insensitive user to dispense bounty and for depicting interchangeable and disposable characters.

2. SUMMARY OF THE INVENTION

Thus, an object of the embodiments of the present invention is to provide a reusable, programmable, interactive, and talking pinata for being hit by a stick by a size-insensitive user to dispense bounty and for depicting interchangeable and disposable characters, which avoids the disadvantages of the prior art.

Briefly stated, another object of the embodiments of the present invention is to provide a reusable, programmable, interactive, and talking pinata for being hit by a stick by a size-insensitive user to dispense bounty and for depicting interchangeable and disposable characters. The pinata includes a character, a first compartment, operating electronics, and a second compartment. The character has a body, and depicts the interchangeable and disposable characters, and as such, is interchangeable and disposable. The body of the character has a top part and a bottom part. The bottom part of the body of the character is pivotally attached to the top part of the body of the character so as to pivot relative thereto. The operating electronics has preselected criteria. The second compartment has a bottom lid and holds the bounty. The bottom lid of the second compartment is affixed to the bottom part of the body of the character so as to pivot therewith. When the reusable, programmable, interactive, and talking pinata is activated by being hit by the stick according to the preselected criteria of the operating electronics, the bottom part of the body of the character pivots away from the top part of the body of the character taking the bottom lid of the second compartment with it, and in doing so, opens the second compartment and dispenses the bounty.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawing.

3. BRIEF DESCRIPTION OF THE FIGURES OF THE DRAWING

The figures of the drawing are briefly described as follows.

4. LIST OF REFERENCE NUMERALS UTILIZED IN THE FIGURES OF THE DRAWING

A. General

Figure 1:
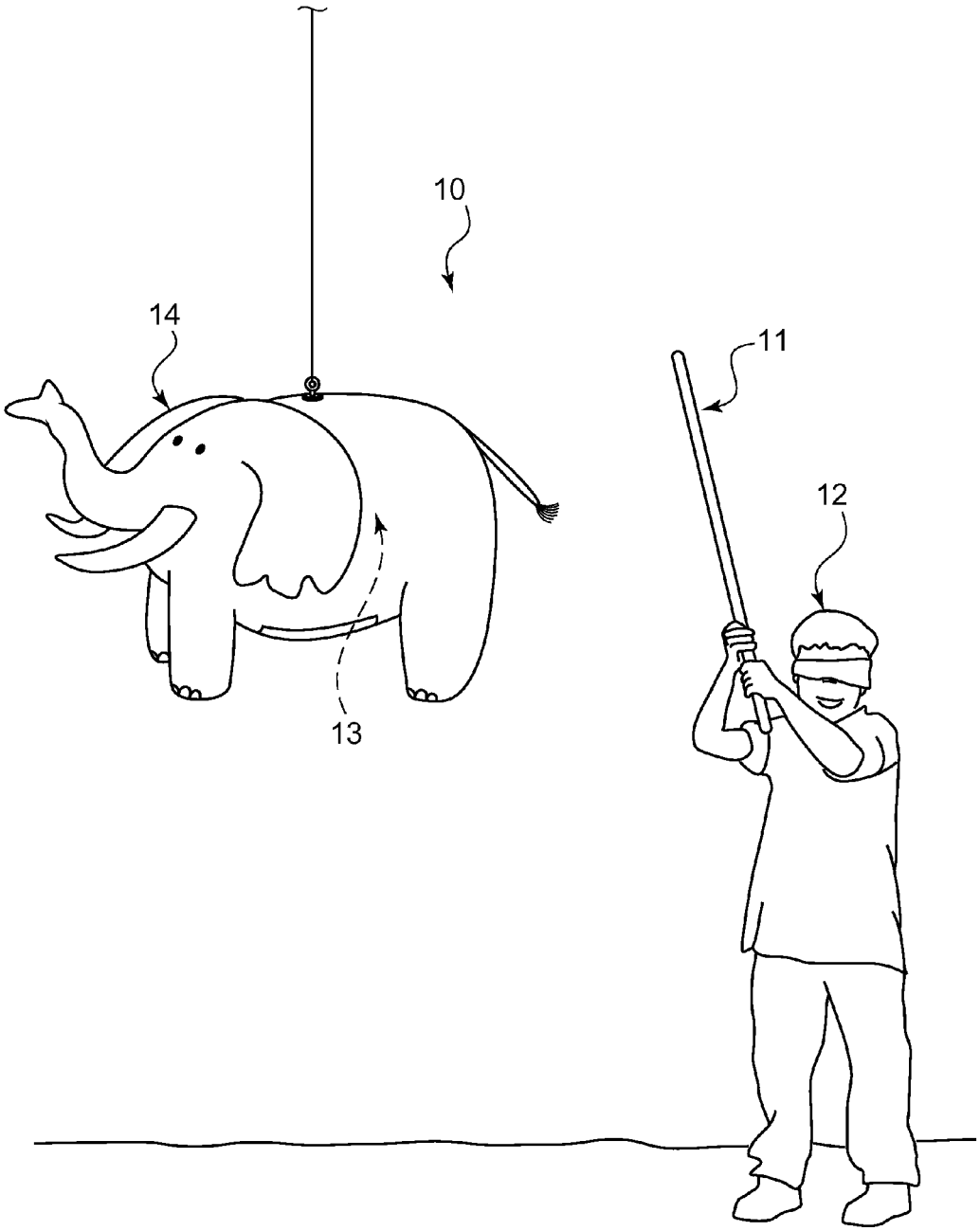
FIG. 1 is a diagrammatic perspective view of the reusable, programmable, interactive, and talking pinata of the embodiments of the present invention beginning to being hit by a stick by a size-insensitive user to dispense bounty and depict interchangeable and disposable characters.

10 reusable, programmable, interactive, and talking pinata of embodiments of present invention for being hit by stick 11 by size-insensitive user 12 to dispense bounty 13 and for depicting interchangeable and disposable characters 14
11 stick
12 size-insensitive user
13 bounty
14 interchangeable and disposable characters

B. Configuration of Reusable, Programmable, Interactive, and Talking Pinata 10

16 character for depicting interchangeable and disposable characters 14
18 first compartment
19 operating electronics
20 second compartment for holding bounty 13
22 body of character 16
24 top part of body 22 of character 16
26 bottom part of body 22 of character 16
28 bottom lid of second compartment 20
30 highest point of top part 24 of body 22 of character 16
32 through bore through highest point 30 of top part 24 of body 22 of character 16
34 common bell-shaped enclosure
36 partition in common bell-shaped enclosure 34
38 hinge of character 16
39 flat portion of common bell-shaped enclosure 34
40 length of string
42 loop of length of string 40 for receiving rope for suspending reusable, programmable, interactive, and talking pinata 10
44 hook and loop fasteners
46 electrically operated latch C. Configuration of Operating Electronics 19

48 CPU of operating electronics 19
49 electronic storage media of operating electronics 19
50 at least one target area of character 16 of operating electronics 19 for providing area that activates reusable, programmable, interactive, and talking pinata 10 when hit by stick 11
52 decorative panel of at least one target area 50 of character 16 of operating electronics 19
54 attachment mechanism of at least one target area 50 of character 16 of operating electronics 19
56 shock mechanism of at least one target area 50 of character 16 of operating electronics 19 for cushioning impact when decorative panel 52 of at least one target area 50 of character 16 of operating electronics 19 is hit by stick 11
58 impact sensor of at least one target area 50 of character 16 of operating electronics 19 for sensing impact when decorative panel 52 of at least one target area 50 of character 16 of operating electronics 19 is hit by stick 11
60 dispensing area of character 16 of operating electronics 19 for providing area for dispensing bounty 13 when reusable, programmable, interactive, and talking pinata 10 is activated
62 openable decorative panel of the dispensing area 60 of character 16 of operating electronics 19
64 hinge mechanism of dispensing area 60 of character 16 of operating electronics 19
66 electrically operated latch of dispensing area 60 of character 16 of operating electronics 19
68 input controls of operating electronics 19
70 first input device of input controls 68 of operating electronics 19
72 randomizer toggle switch of input controls 68 of operating electronics 19
74 power source interface of input controls 68 of operating electronics 19
76 power switch of input controls 68 of operating electronics 19
78 audio system of operating electronics 19 for providing audio when reusable, programmable, interactive, and talking pinata 10 is activated
80 audio chip/card of audio system 78 of operating electronics 19 for producing sound signals
82 volume control of audio system 78 of operating electronics 19 for controlling amplitude of output of audio chip/card 80 of audio system 78 of operating electronics 19
84 microphone of audio system 78 of operating electronics 19 for recording user preferences into audio chip/card 80 of audio system 78 of operating electronics 19
86 speaker of audio system 78 of operating electronics 19 for producing sound in response to sound signals produced by audio chip/card 80 of audio system 78 of operating electronics 19
88 second input device of audio system 78 of operating electronics 19 for inputting which and when audio is to be played

5. DETAILED DESCRIPTION OF THE PREFERRED EMBODIMENTS

A. General

Figure 2:
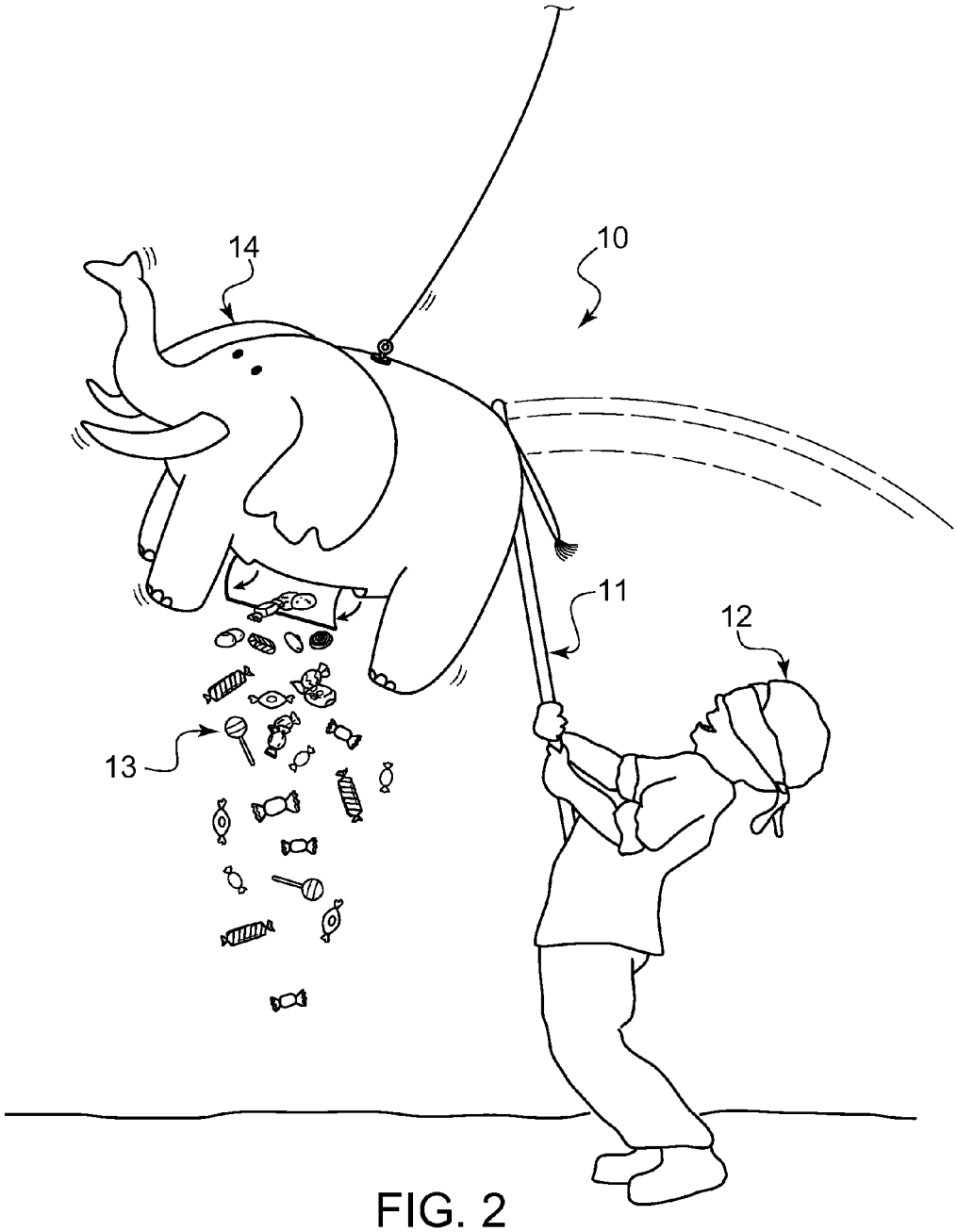
FIG. 2 is a diagrammatic perspective view of the reusable, programmable, interactive, and talking pinata of the embodiments of the present invention being hit by a stick by a size-insensitive user to dispense bounty and depict interchangeable and disposable characters.

Referring now to the figures, in which like numerals indicate like parts, and particularly to FIGS. 1 and 2, which are, respectively, a diagrammatic perspective view of the reusable, programmable, interactive, and talking pinata of the embodiments of the present invention beginning to being hit by a stick by a size-insensitive user to dispense bounty and depict interchangeable and disposable characters, and a diagrammatic perspective view of the reusable, programmable, interactive, and talking pinata of the embodiments of the present invention being hit by a stick by a size-insensitive user to dispense bounty and depict interchangeable and disposable characters, the reusable, programmable, interactive, and talking pinata of the embodiments of the present invention is shown generally at 10 for being hit by a stick 11 by a size-insensitive user 12 to dispense bounty 13 and for depicting interchangeable and disposable characters 14. The bounty 13 includes candy, treats, prizes, etc.

B. Configuration of the Reusable, Programmable, Interactive, and Talking Pinata 10

Figure 3:
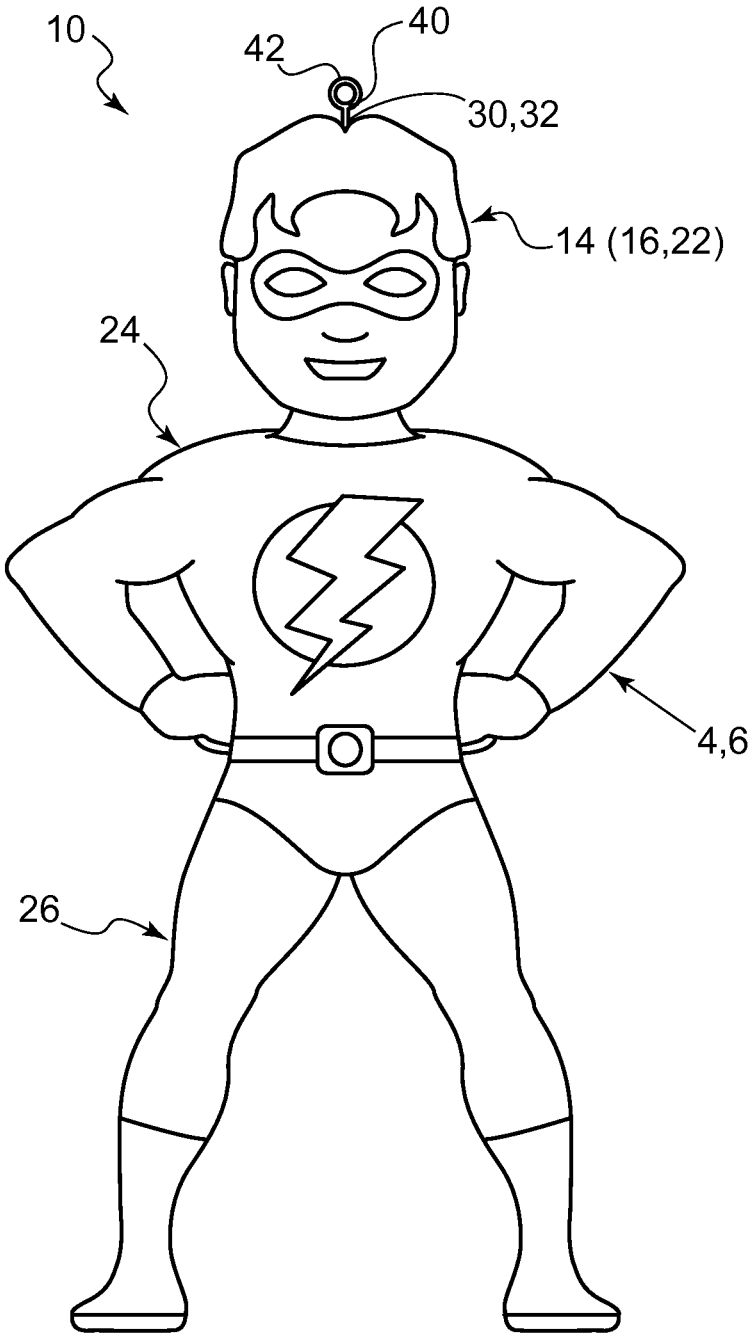
FIG. 3 is a diagrammatic front elevational view of the reusable, programmable, interactive, and talking pinata of the embodiments of the present invention before use.
Figures 4, 5:
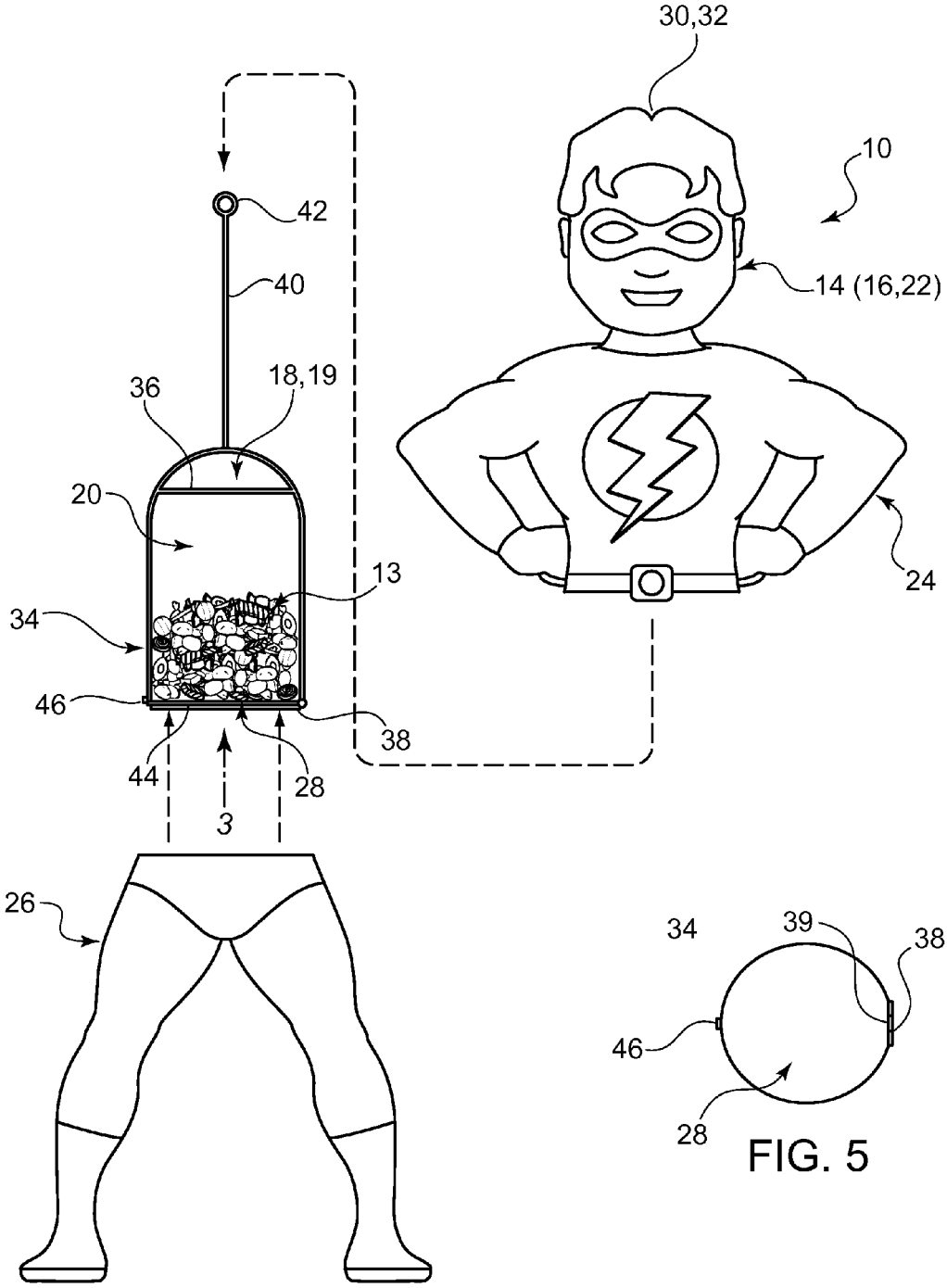
FIG. 4 is an exploded diagrammatic front elevational view of the reusable, programmable, interactive, and talking pinata of the embodiments of the present invention identified by ARROW 4 in FIG. 3.
FIG. 5 is a diagrammatic bottom plan view taken generally in the direction of ARROW 5 in FIG. 4.
Figure 6:
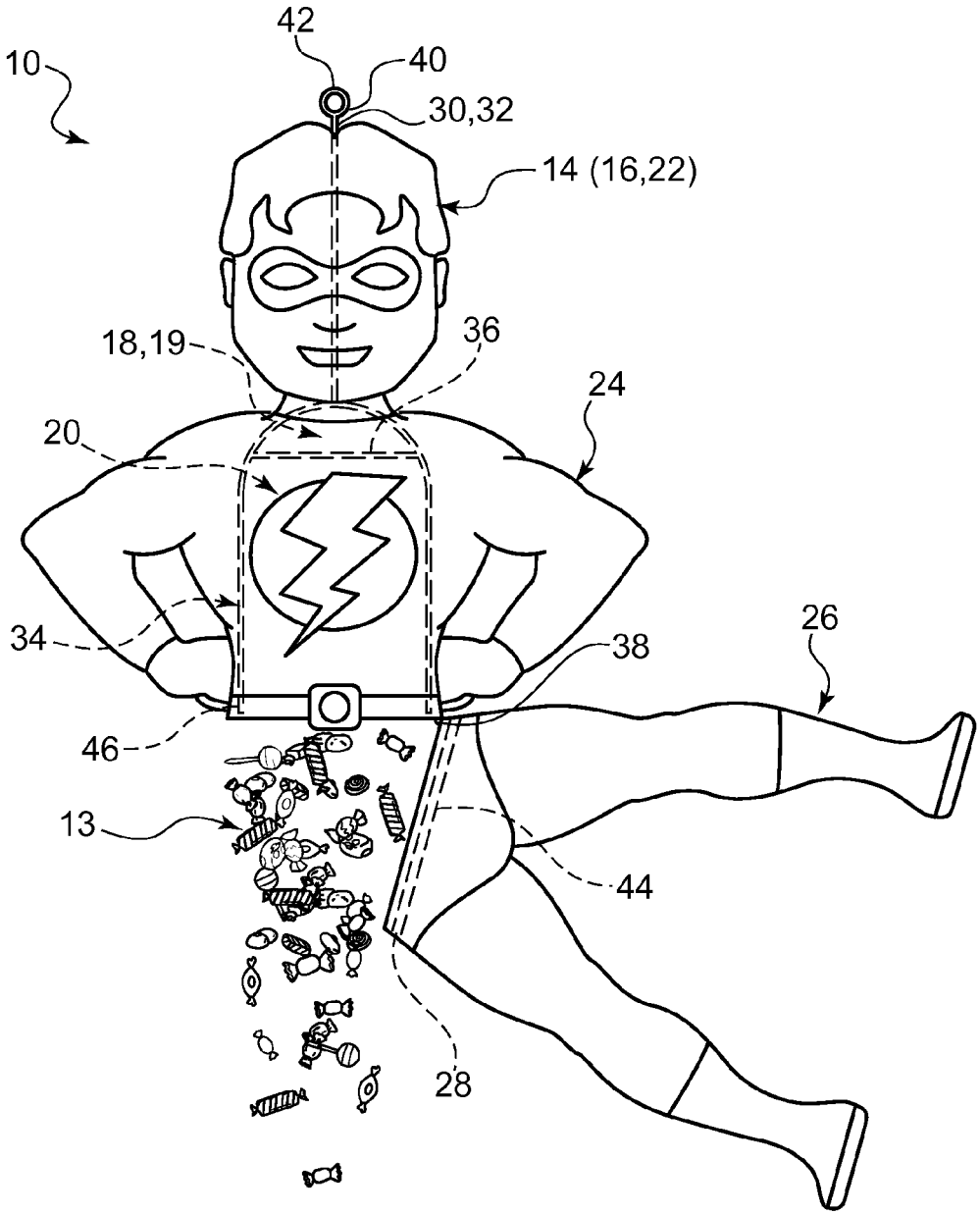
FIG. 6 is a diagrammatic front elevational view of the reusable, programmable, interactive, and talking pinata of the embodiments of the present invention identified by ARROW 6 in FIG. 3 after use.

The configuration of the reusable, programmable, interactive, and talking pinata 10 can best be seen in FIGS. 3-6, which are, respectively, a diagrammatic front elevational view of the reusable, programmable, interactive, and talking pinata of the embodiments of the present invention before use, an exploded diagrammatic front elevational view of the reusable, programmable, interactive, and talking pinata of the embodiments of the present invention identified by ARROW 4 in FIG. 3, a diagrammatic bottom plan view taken generally in the direction of ARROW 5 in FIG. 4, and a diagrammatic front elevational view of the reusable, programmable, interactive, and talking pinata of the embodiments of the present invention identified by ARROW 6 in FIG. 3 after use, and as such, will be discussed with reference thereto.

The reusable, programmable, interactive, and talking pinata 10 comprises a character 16, a first compartment 18, operating electronics 19, and a second compartment 20.

The character 16 has a body 22, and is for depicting the interchangeable and disposable characters 14, and as such, is interchangeable and disposable.

The body 22 of the character 16 has a top part 24 and a bottom part 26.

The bottom part 26 of the body 22 of the character 16 is pivotally attached to the top part 24 of the body 22 of the character 16 so as to pivot relative thereto.

The first compartment 18 is disposed within the top part 24 of the body 22 of the character 16, and holds the operating electronics 19.

The operating electronics 19 has preselected criteria.

The second compartment 20 is disposed within the top part 24 of the body 22 of the character 16, has a bottom lid 28, and is for holding the bounty 13.

The bottom lid 28 of the second compartment 20 is affixed to the bottom part 26 of the body 22 of the character 16 so as to pivot therewith, and when the reusable, programmable, interactive, and talking pinata 10 is activated, the bottom part 26 of the body 22 of the character 16 pivots away from the top part 24 of the body 22 of the character 16 taking the bottom lid 28 of the second compartment 20 with it, and in doing so, opens the second compartment 20 and dispenses the bounty 13.

The top part 24 of the body 22 of the character 16 has a highest point 30. The highest point 30 of the top part 24 of the body 22 of the character 16 has a through bore 32 therethrough.

The first compartment 18 and the second compartment 20 share a common bell-shaped enclosure 34, with the first compartment 18 sitting on top of the second compartment 20 and being separated therefrom by a partition 36.

The common bell-shaped enclosure 34 is made of hard plastic.

The bottom lid 28 of the second compartment 20 is hingedly attached to the common bell-shaped enclosure 34 by a hinge 38, and since the bottom lid 28 of the second compartment 20 is affixed to the bottom part 26 of the body 22 of the character 16, the hinge 38 also allows the bottom part 26 of the body 22 of the character 16 to pivot relative to the top part 24 of the body 22 of the character 16.

The common bell-shaped enclosure 34 has a flat portion 39. The flat portion 39 of the common bell-shaped enclosure 34 is adjacent to the bottom lid 28 of the second compartment 20 so as to provide a mounting surface for the hinge 38.

The reusable, programmable, interactive, and talking pinata 10 further comprises a length of string 40. The length of string 40 extends upwardly from the common bell-shaped enclosure 34, through the through bore 32 through the highest point 30 of the top part 24 of the body 22 of the character 16, and terminates in a loop 42. The loop 42 of the length of string 40 is for receiving a rope for suspending the reusable, programmable, interactive, and talking pinata 10.

The bottom lid 28 of the second compartment 20 is affixed to the bottom part 26 of the body 22 of the character 16 by hook and loop fasteners 44 or the like.

The reusable, programmable, interactive, and talking pinata 10 further comprises an electrically operated latch 46. The electrically operated latch 46 selectively latches the bottom lid 28 of the second compartment 20 to the common bell-shaped enclosure 34.

C. Configuration of the Operating Electronics 19

Figure 7:
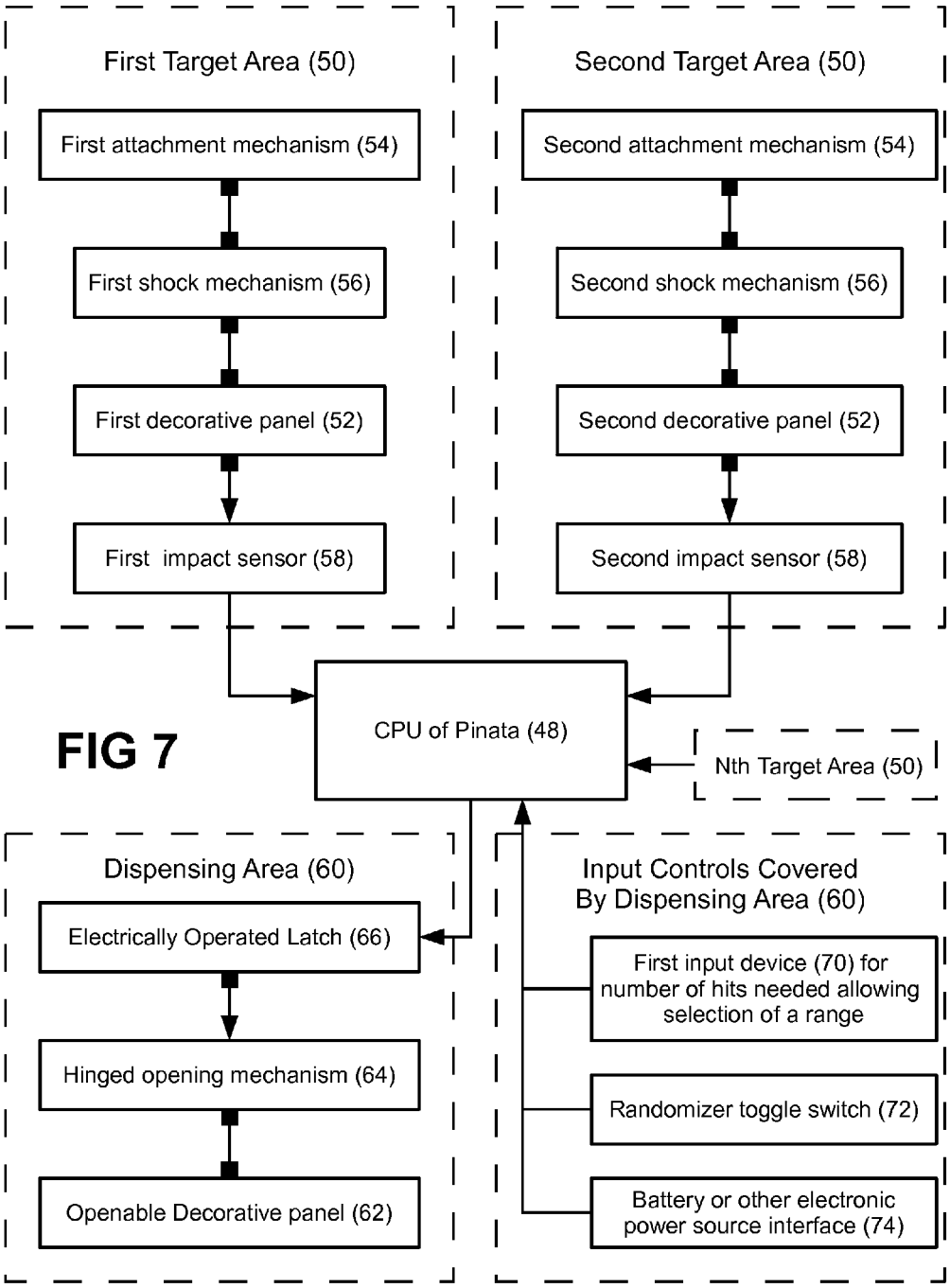
FIG. 7 is a diagrammatic block diagram of the operating electronics of the reusable, programmable, interactive, and talking pinata of the embodiments of the present invention.
Figure 8:
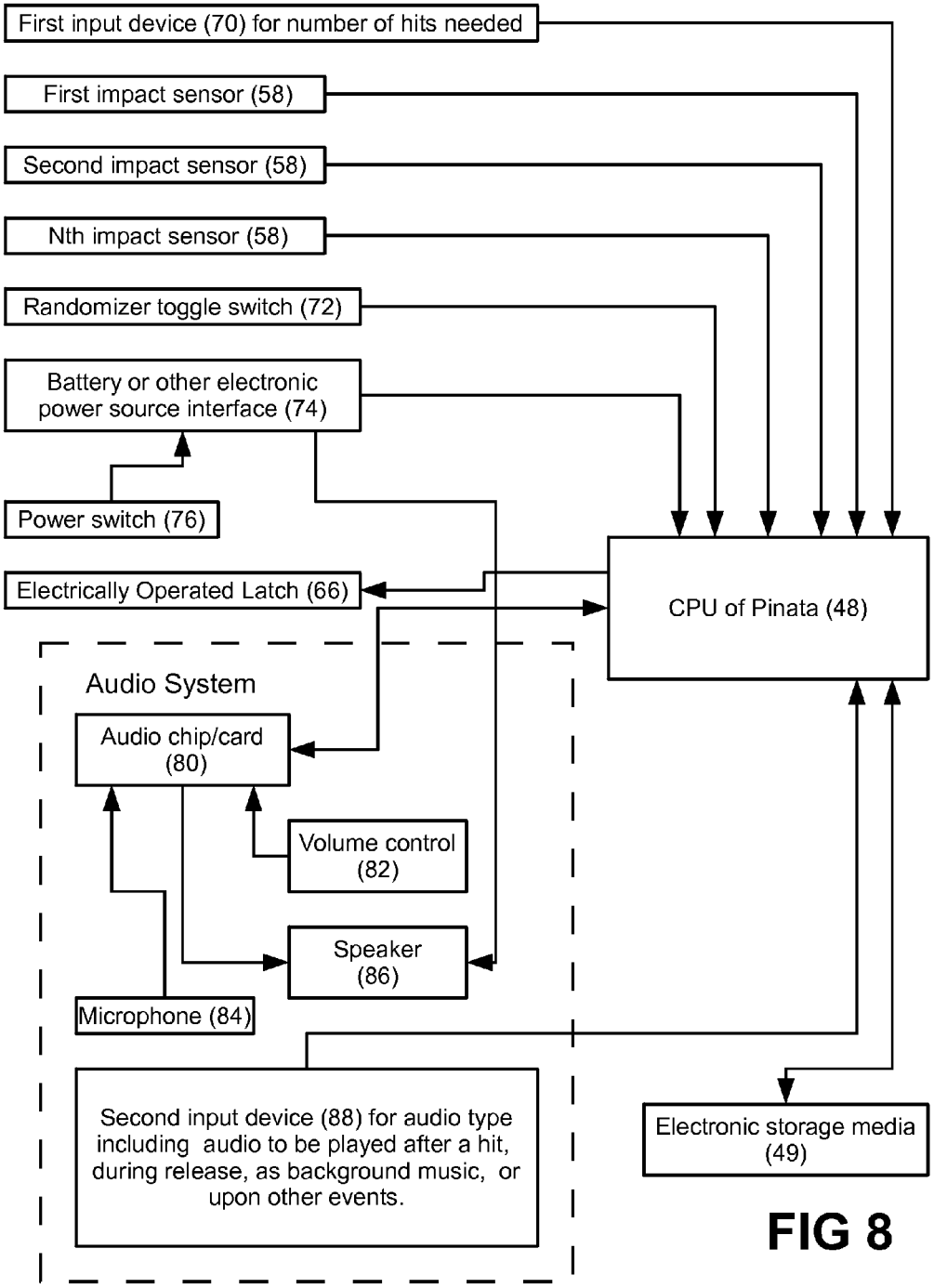
FIG. 8 is another diagrammatic block diagram of the operating electronics of the reusable, programmable, interactive, and talking pinata of the embodiments of the present invention.

The configuration of the operating electronics 19 can best be seen in FIGS. 7 and 8, which are, respectively, a diagrammatic block diagram of the operating electronics of the reusable, programmable, interactive, and talking pinata of the embodiments of the present invention, and another diagrammatic block diagram of the operating electronics of the reusable, programmable, interactive, and talking pinata of the embodiments of the present invention, and as such, will be discussed with reference thereto.

The operating electronics 19 comprises a CPU 48 and an electronic storage media 49. The electronic storage media 49 of the operating electronics 19 is operatively connected to the CPU 48 of the operating electronics 19.

The operating electronics 19 further comprises the character 16 having at least one target area 50. The at least one target area 50 of the character 16 of the operating electronics 19 is for providing an area that activates the reusable, programmable, interactive, and talking pinata 10 when hit by the stick 11.

The operating electronics 19 further comprises the at least one target area 50 of the character 16 of the operating electronics 19 having a decorative panel 52. The decorative panel 52 of the at least one target area 50 of the character 16 of the operating electronics 19 conforms to an associated portion of the character 16.

The operating electronics 19 further comprises the at least one target area 50 of the character 16 of the operating electronics 19 further having an attachment mechanism 54. The attachment mechanism 54 of the at least one target area 50 of the character 16 of the operating electronics 19 attaches the decorative panel 52 of the at least one target area 50 of the character 16 of the operating electronics 19 to the character 16.

The operating electronics 19 further comprises the at least one target area 50 of the character 16 of the operating electronics 19 further having a shock mechanism 56. The shock mechanism 56 of the at least one target area 50 of the character 16 of the operating electronics 19 is for cushioning impact when the decorative panel 52 of the at least one target area 50 of the character 16 of the operating electronics 19 is hit by the stick 11.

The operating electronics 19 further comprises the at least one target area 50 of the character 16 of the operating electronics 19 further having an impact sensor 58. The impact sensor 58 of the at least one target area 50 of the character 16 of the operating electronics 19 is operatively connected to the CPU 48 of the operating electronics 19 and is for sensing impact when the decorative panel 52 of the at least one target area 50 of the character 16 of the operating electronics 19 is hit by the stick 11.

The operating electronics 19 further comprises the character 16 having a dispensing area 60. The dispensing area 60 of the character 16 of the operating electronics 19 is for providing an area for dispensing the bounty 13 when the reusable, programmable, interactive, and talking pinata 10 is activated.

The operating electronics 19 further comprises the dispensing area 60 of the character 16 of the operating electronics 19 having an openable decorative panel 62. The openable decorative panel 62 of the dispensing area 60 of the character 16 of the operating electronics 19 conforms to an associated portion of the character 16, and is generic for the bottom lid 28 of the second compartment 20.

The operating electronics 19 further comprises the dispensing area 60 of the character 16 of the operating electronics 19 further having a hinge mechanism 64. The hinge mechanism 64 of the dispensing area 60 of the character 16 of the operating electronics 19 attaches the openable decorative panel 62 of the dispensing area 60 of the character 16 of the operating electronics 19 to the character 16, and is generic for the hinge 38.

The operating electronics 19 further comprises the dispensing area 60 of the character 16 of the operating electronics 19 further having an electrically operated latch 66. The electrically operated latch 66 of the dispensing area 60 of the character 16 of the operating electronics 19 is operatively connected to the CPU 48 of the operating electronics 19, allows the openable decorative panel 62 of the dispensing area 60 of the character 16 of the operating electronics 19 to selectively open, and is generic for the electrically operated latch 46.

The operating electronics 19 further comprises input controls 68. The input controls 68 of the operating electronics 19 are covered by the openable decorative panel 62 of the dispensing area 60 of the character 16 of the operating electronics 19.

The operating electronics 19 further comprises the input controls 68 of the operating electronics 19 having a first input device 70. The first input device 70 of the input controls 68 of the operating electronics 19 is operatively connected to the CPU 48 of the operating electronics 19, and inputs a number of hits, or a range of hits, needed to activate the reusable, programmable, interactive, and talking pinata 10.

The operating electronics 19 further comprises the input controls 68 of the operating electronics 19 having a randomizer toggle switch 72. The randomizer toggle switch 72 of the input controls 68 of the operating electronics 19 is operatively connected to the CPU 48 of the operating electronics 19, and determines randomly a number of hits needed to activate the reusable, programmable, interactive, and talking pinata 10.

The operating electronics 19 further comprises the input controls 68 of the operating electronics 19 having a power source interface 74. The power source interface 74 of the input controls 68 of the operating electronics 19 is operatively connected to the CPU 48 of the operating electronics 19.

The operating electronics 19 further comprises the input controls 68 of the operating electronics 19 having a power switch 76. The power switch 76 of the input controls 68 the operating electronics 19 is operatively connected to the power source interface 74 of the input controls 68 of the operating electronics 19, and selectively operates the operating electronics 19.

The operating electronics 19 further comprises an audio system 78. The audio system 78 of the operating electronics 19 is for providing audio when the reusable, programmable, interactive, and talking pinata 10 is activated.

The operating electronics 19 further comprises the audio system 78 of the operating electronics 19 having an audio chip/card 80. The audio chip/card 80 of the audio system 78 of the operating electronics 19 is operatively connected to the CPU 48 of the operating electronics 19, and is for producing sound signals.

The operating electronics 19 further comprises the audio system 78 of the operating electronics 19 having a volume control 82. The volume control 82 of the audio system 78 of the operating electronics 19 is operatively connected to the audio chip/card 80 of the audio system 78 of the operating electronics 19, and is for controlling amplitude of the output of the audio chip/card 80 of the audio system 78 of the operating electronics 19.

The operating electronics 19 further comprises the audio system 78 of the operating electronics 19 having a microphone 84. The microphone 84 of the audio system 78 of the operating electronics 19 is operatively connected to the audio chip/card 80 of the audio system 78 of the operating electronics 19, and is for recording user preferences into the audio chip/card 80 of the audio system 78 of the operating electronics 19.

The operating electronics 19 further comprises the audio system 78 of the operating electronics 19 having a speaker 86. The speaker 86 of the audio system 78 of the operating electronics 19 is operatively connected to the audio chip/card 80 of the audio system 78 of the operating electronics 19 and the power source interface 74 of the input controls 68 of the operating electronics 19, and is for producing sound in response to the sound signals produced by the audio chip/card 80 of the audio system 78 of the operating electronics 19.

The operating electronics 19 further comprises the audio system 78 of the operating electronics 19 having a second input device 88. The second input device 88 of the audio system 78 of the operating electronics 19 is operatively connected to the CPU 48 of the operating electronics 19, and is for inputting which and when audio is to be played.

The CPU 48 of the operating electronics 19 is programmable to:

Allow the number of hits the character 16 is hit by the stick 11 to be counted;

Allow the number of hits the character 16 is hit by the stick 11 to be registered;

Allow background music when the pinata 10 is turned on to be played via the audio system 78 of the operating electronics 19;

Respond to each hit with pre-recorded phrases via the audio system 78 of the operating electronics 19;

Allow the size-insensitive user 12 to select the number of hits at which the dispensing area 60 of the character 16 of the operating electronics 19 will be activated via the first input device 70 of the input controls 68 of the operating electronics 19; and Allow the size-insensitive user 12 to set a range number of hits within which the dispensing area 60 of the character 16 of the operating electronics 19 will be randomly activated.

D. Impressions

It will be understood that each of the elements described above or two or more together may also find a useful application in other types of constructions differing from the types described above.

While the embodiments of the present invention have been illustrated and described as embodied in a reusable, programmable, interactive, and talking pinata for being hit by a stick by a size-insensitive user to dispense bounty and for depicting interchangeable and disposable characters, nevertheless, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A reusable, programmable, interactive, and talking pinata for being hit by a stick by a size-insensitive user to dispense bounty and for depicting interchangeable and disposable characters, comprising:

a) a character;

b) a first compartment;

c) operating electronics; and d) a second compartment;

wherein said character is for depicting the interchangeable and disposable characters, and as such, is interchangeable and disposable;

wherein said character has a body;

wherein said body of said character has a top part;

wherein said body of said character has a bottom part;

wherein said bottom part of said body of said character is pivotally attached to said top part of said body of said character so as to pivot relative thereto;

wherein said operating electronics has preselected criteria;

wherein said second compartment has a bottom lid;

wherein said second compartment is for holding the bounty;

wherein said bottom lid of said second compartment is affixed to said bottom part of said body of said character so as to pivot therewith; and wherein when said reusable, programmable, interactive, and talking pinata is activated, said bottom part of said body of said character pivots away from said top part of said body of said character taking said bottom lid of said second compartment with it, and in doing so, opens said second compartment and dispenses the bounty.

2. The pinata of claim 1, wherein said first compartment holds said operating electronics;

wherein said first compartment is disposed within said top part of said body of said character; and wherein said second compartment is disposed within said top part of said body of said character.

3. The pinata of claim 1, wherein said top part of said body of said character has a highest point; and wherein said highest point of said top part of said body of said character has a through bore therethrough.

4. The pinata of claim 3, wherein said first compartment and said second compartment share a common bell-shaped enclosure;

wherein said first compartment sits on top of said second compartment; and wherein said first compartment is separated from said second compartment by a partition.

5. The pinata of claim 4, wherein said common bell-shaped enclosure is made of hard plastic.

6. The pinata of claim 4, wherein said bottom lid of said second compartment is hingedly attached to said common bell-shaped enclosure by a hinge; and wherein since said bottom lid of said second compartment is affixed to said bottom part of said body of said character, said hinge also allows said bottom part of said body of said character to pivot relative to said top part of said body of said character.

7. The pinata of claim 6, wherein said common bell-shaped enclosure has a flat portion; and wherein said flat portion of said common bell-shaped enclosure is adjacent to said bottom lid of said second compartment so as to provide a mounting surface for said hinge.

8. The pinata of claim 4, further comprising a length of string;

wherein said length of string extends upwardly from said common bell-shaped enclosure, through said through bore through said highest point of said top part of said body of said character, and terminates in a loop; and wherein said loop of said length of string is for receiving a rope for suspending said reusable, programmable, interactive, and talking pinata.

9. The pinata of claim 1, wherein said bottom lid of said second compartment is affixed to said bottom part of said body of said character by hook and loop fasteners.

10. The pinata of claim 4, further comprising an electrically operated latch; and wherein said electrically operated latch selectively latches said bottom lid of said second compartment to said common bell-shaped enclosure.

11. The pinata of claim 6, wherein said operating electronics comprises:

a) a CPU; and b) an electronic storage media;

wherein said electronic storage media of said operating electronics is operatively connected to said CPU of said operating electronics.

12. The pinata of claim 11, wherein said operating electronics comprises said character having at least one target area; and wherein said at least one target area of said character of said operating electronics is for providing an area that activates said reusable, programmable, interactive, and talking pinata when hit by the stick.

13. The pinata of claim 12, wherein said operating electronics comprises said at least one target area of said character of said operating electronics having a decorative panel; and wherein said decorative panel of said at least one target area of said character of said operating electronics conforms to an associated portion of said character.

14. The pinata of claim 13, wherein said operating electronics comprises said at least one target area of said character of said operating electronics having an attachment mechanism; and wherein said attachment mechanism of said at least one target area of said character of said operating electronics attaches said decorative panel of said at least one target area of said character of said operating electronics to said character.

15. The pinata of claim 13, wherein said operating electronics comprises said at least one target area of said character of said operating electronics having a shock mechanism; and wherein said shock mechanism of said at least one target area of said character of said operating electronics is for cushioning impact when said decorative panel of said at least one target area of said character of said operating electronics is hit by the stick.

16. The pinata of claim 13, wherein said operating electronics comprises said at least one target area of said character of said operating electronics having an impact sensor;

wherein said impact sensor of said at least one target area of said character of said operating electronics is operatively connected to said CPU of said operating electronics; and wherein said impact sensor of said at least one target area of said character of said operating electronics is for sensing impact when said decorative panel of said at least one target area of said character of said operating electronics is hit by the stick.

17. The pinata of claim 11, wherein said operating electronics comprises said character having a dispensing area; and wherein said dispensing area of said character of said operating electronics is for providing an area for dispensing the bounty when said reusable, programmable, interactive, and talking pinata is activated.

18. The pinata of claim 17, wherein said operating electronics comprises said dispensing area of said character of said operating electronics having an openable decorative panel; and wherein said openable decorative panel of said dispensing area of said character of said operating electronics conforms to an associated portion of said character.

19. The pinata of claim 18, wherein said operating electronics comprises said dispensing area of said character of said operating electronics having a hinge mechanism; and wherein said hinge mechanism of said dispensing area of said character of said operating electronics attaches said openable decorative panel of said dispensing area of said character of said operating electronics to said character.

20. The pinata of claim 18, wherein said operating electronics comprises said dispensing area of said character of said operating electronics having an electrically operated latch;

wherein said electrically operated latch of said dispensing area of said character of said operating electronics is operatively connected to said CPU of said operating electronics; and wherein said electrically operated latch of said dispensing area of said character of said operating electronics allows said openable decorative panel of said dispensing area of said character to selectively open.

21. The pinata of claim 18, wherein said operating electronics comprises input controls; and wherein said input controls of said operating electronics are covered by said openable decorative panel of said dispensing area of said character.

22. The pinata of claim 21, wherein said operating electronics comprises said input controls of said operating electronics having a first input device;

wherein said first input device of said input controls of said operating electronics is operatively connected to said CPU of said operating electronics; and wherein said first input device of said input controls of said operating electronics inputs a number of hits, or a range of hits, needed to activate said reusable, programmable, interactive, and talking pinata.

23. The pinata of claim 21, wherein said operating electronics comprises said input controls of said operating electronics having a randomizer toggle switch;

wherein said randomizer toggle switch of said input controls of said operating electronics is operatively connected to said CPU of said operating electronics; and wherein said randomizer toggle switch of said input controls of said operating electronics determines randomly a number of hits needed to activate said reusable, programmable, interactive, and talking pinata.

24. The pinata of claim 22, wherein said operating electronics comprises said input controls of said operating electronics having a power source interface; and wherein said power source interface of said input controls of said operating electronics is operatively connected to said CPU of said operating electronics.

25. The pinata of claim 24, wherein said operating electronics comprises said input controls of said operating electronics having a power switch;

wherein said power switch of said input controls of said operating electronics is operatively connected to said power source interface of said input controls of said operating electronics; and wherein said power switch of said input controls of said operating electronics selectively operates said operating electronics.

26. The pinata of claim 24, wherein said operating electronics comprises an audio system; and wherein said audio system of said operating electronics is for providing audio when said reusable, programmable, interactive, and talking pinata is activated.

27. The pinata of claim 26, wherein said operating electronics comprises said audio system of said operating electronics having an audio chip/card;

wherein said audio chip/card of said audio system of said operating electronics is operatively connected to said CPU of said operating electronics; and wherein said audio chip/card of said audio system of said operating electronics is for producing sound signals.

28. The pinata of claim 27, wherein said operating electronics comprises said audio system of said operating electronics having a volume control;

wherein said volume control of said audio system of said operating electronics is operatively connected to said audio chip/card of said audio system of said operating electronics; and wherein said volume control of said audio system of said operating electronics is for controlling amplitude of the output of said audio chip/card of said audio system of said operating electronics.

29. The pinata of claim 27, wherein said operating electronics comprises said audio system of said operating electronics having a microphone;

wherein said microphone of said audio system of said operating electronics is operatively connected to said audio chip/card of said audio system of said operating electronics; and wherein said microphone of said audio system of said operating electronics is for recording user preferences into said audio chip/card of said audio system of said operating electronics.

30. The pinata of claim 27, wherein said operating electronics comprises said audio system of said operating electronics having a speaker;

wherein said speaker of said audio system of said operating electronics is operatively connected to said audio chip/card of said audio system of said operating electronics;

wherein said speaker of said audio system of said operating electronics is operatively connected to said power source interface of said input controls of said operating electronics; and wherein said speaker of said audio system of said operating electronics is for producing sound in response to the sound signals produced by said audio chip/card of said audio system of said operating electronics.

31. The pinata of claim 26, wherein said operating electronics comprises said audio system of said operating electronics having a second input device;

wherein said second input device of said audio system of said operating electronics is operatively connected to said CPU of said operating electronics; and wherein said second input device of said audio system of said operating electronics is for inputting which and when audio is to be played.

32. The pinata of claim 19, wherein said hinge mechanism of said dispensing area of said character of said operating electronics is said hinge; and wherein said openable decorative panel of said dispensing area of said character is said bottom lid of said second compartment.

33. The pinata of claim 26, wherein said CPU of said operating electronics is programmable to allow the number of hits said character is hit by the stick to be counted;

wherein said CPU of said operating electronics is programmable to allow the number of hits said character is hit by the stick to be registered;

wherein said CPU of said operating electronics is programmable to allow background music when said pinata is turned on to be played via said audio system of said operating electronics;

wherein said CPU of said operating electronics is programmable to respond to each hit with pre-recorded phrases via said audio system of said operating electronics;

wherein said CPU of said operating electronics is programmable to allow the size-insensitive user to select the number of hits at which said dispensing area of said character of said operating electronics will be activated via said first input device of said input controls of said operating electronics; and wherein said CPU of said operating electronics is programmable to allow the size-insensitive user to set a range number of hits within which said dispensing area of said character of said operating electronics will be randomly activated.

* * * * *